US006954602B2

(12) United States Patent
Kimizuka

(10) Patent No.: US 6,954,602 B2
(45) Date of Patent: Oct. 11, 2005

(54) SHEET TRANSPORT APPARATUS AND IMAGE FORMING APPARATUS

(75) Inventor: Eiichiro Kimizuka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 63 days.

(21) Appl. No.: 10/697,280

(22) Filed: Oct. 31, 2003

(65) Prior Publication Data

US 2004/0091281 A1 May 13, 2004

(30) Foreign Application Priority Data

Nov. 8, 2002 (JP) ..... 2002-326051

(51) Int. Cl.[7] ..... G03G 15/00; G03G 21/20

(52) U.S. Cl. ..... 399/92; 399/110; 399/364; 399/401

(58) Field of Search ..... 399/92, 91, 401, 399/110, 125, 107, 364, 341, 406

(56) References Cited

U.S. PATENT DOCUMENTS 4,959,693 A * 9/1990 Mitsuya et al. ..... 399/401 X
6,256,464 B1 * 7/2001 Sumiyoshi ..... 399/364 X
6,564,019 B2 * 5/2003 Ahn et al. ..... 399/364 X
2002/0127038 A1 * 9/2002 Omura ..... 399/401
2004/0131378 A1 * 7/2004 Hattori et al. ..... 399/107 X

FOREIGN PATENT DOCUMENTS

JP 01-242327 A * 9/1989
JP 07-239647 A * 9/1995
JP 11-015209 A * 1/1999
JP 2000-338727 A * 12/2000
JP 2002-096942 A * 4/2002
JP 2002-241022 A * 8/2002
JP 2003-280293 A * 10/2003

* cited by examiner

*Primary Examiner*—Sophia S Chen
(74) *Attorney, Agent, or Firm*—Fitzpatrick, Cella, Harper & Scinto

(57) ABSTRACT

A sheet transport apparatus that re-transports a sheet having an image formed by an image forming portion on a first surface of the sheet, to the image forming portion in order to form an image on a second surface of the sheet on a side opposite to the first surface, the sheet transport apparatus including: a re-transport path through which the sheet is re-transported to the image forming portion again; a cooling unit for blowing air into the re-transport path in order to cool the sheet passing through the re-transport path; and an electrical substrate, in which the air having been blown to the sheet from the cooling unit to cool the sheet is prevented from striking the electrical substrate.

11 Claims, 5 Drawing Sheets

SHEET TRANSPORT APPARATUS AND IMAGE FORMING APPARATUS

BACKGROUND OF THE INVENTION

1. Field of the Invention

The present invention relates to a sheet transport apparatus, which transports a sheet, and an image forming apparatus that uses the sheet transport apparatus.

2. Related Background Art

Conventionally, there have been used electrophotographic image forming apparatuses, such as copying machines, printers, and facsimiles, which form an image on a first surface of a sheet and then form an image on a second surface of the sheet on an opposite side using an image forming portion, for instance. In such an image forming apparatus that forms images on both surfaces of a sheet in this manner, after a toner image formed on a photosensitive drum is transferred onto a first surface of the sheet, the transferred toner image is heated and pressurized by a fixing means for fixation. Following this, the sheet is sent to an image forming portion again through a re-transport path and a toner image is transferred onto a second surface of the sheet and is fixed by the fixing means.

During this operation, it is necessary to heat the sheet for fixing the toner image on the first surface. If the sheet is sent to the image forming portion again and image formation on the second surface of the sheet is performed while the sheet is still heated, it is possible that a defective image may be formed on the second surface due to the influence of the heat of the sheet. In view of this problem, there is adopted a system in which, after the image formation on the first surface, the sheet having the image formed on the first surface is cooled using a fan or the like on the downstream side of the fixing means or in the re-transport path.

However, a control substrate for controlling the image forming portion and a sheet transport portion is also arranged inside the image forming apparatus, and consequently, air heated as a result of the cooling operation, strikes the control substrate and increases the temperatures of elements on the control substrate, which may cause a control failure.

Also, in recent years, the speeding up of the transport process and image forming process of image forming apparatuses results in the increase of the amount of heat generation, and therefore the influence on the control substrate is further increased. Further, if a fan for cooling the control substrate is arranged separately from the fan for cooling the sheet heated as a result of the heating operation in the fixing means, for instance, this results in increases in apparatus size and cost.

SUMMARY OF THE INVENTION

The present invention has been made in the view of the circumstances described above, and provides a sheet transport apparatus which is capable of reducing an influence of heat of a sheet passing through a re-transport path on a control substrate, and an image forming apparatus that uses the sheet transport apparatus.

According to the present invention, there is provided a sheet transport apparatus that transports a sheet having an image formed by an image forming portion on a first surface of the sheet, to the image forming portion in order to form an image on a second surface of the sheet on an opposite side, the sheet transport apparatus including: a re-transport path through which the sheet is re-transported to the image forming portion; a cooling means for blowing air into the re-transport path in order to cool the sheet passing through the re-transport path; and an electrical substrate, in which the air having been blown to the sheet from the cooling means to cool the sheet is prevented from striking the electrical substrate.

According to the present invention, there is provided an image forming apparatus including: an image forming portion; a sheet transport apparatus that re-transports a sheet having an image formed by an image forming portion on a first surface of the sheet, to the image forming portion in order to form an image on a second surface of the sheet on a side opposite to the first surface; a re-transport path through which the sheet transport apparatus re-transports the sheet to the image forming portion; a cooling means for blowing air into the re-transport path in order to cool the sheet passing through the re-transport path; and an electrical substrate, in which the air having been blown to the sheet from the cooling means to cool the sheet is prevented from striking the electrical substrate.

According to the present invention, there is provided an image forming apparatus including: a photosensitive drum on which a toner image is formed; a fixing roller that heats and pressurizes a sheet on which the toner image formed on the photosensitive drum has been transferred; a re-transport path that connects a downstream side path of the fixing roller and an upstream side path of the photosensitive drum to each other; a fan that blows air; and an electrical substrate, in which the electrical substrate, the fan, and the re-transport path are arranged in the stated order from an upstream side along a flowing direction of the air blown by the fan.

DESCRIPTION OF THE PREFERRED EMBODIMENTS

Embodiments of the present invention will be hereinafter described in detail with reference to the accompanying drawings.

Figure 1:
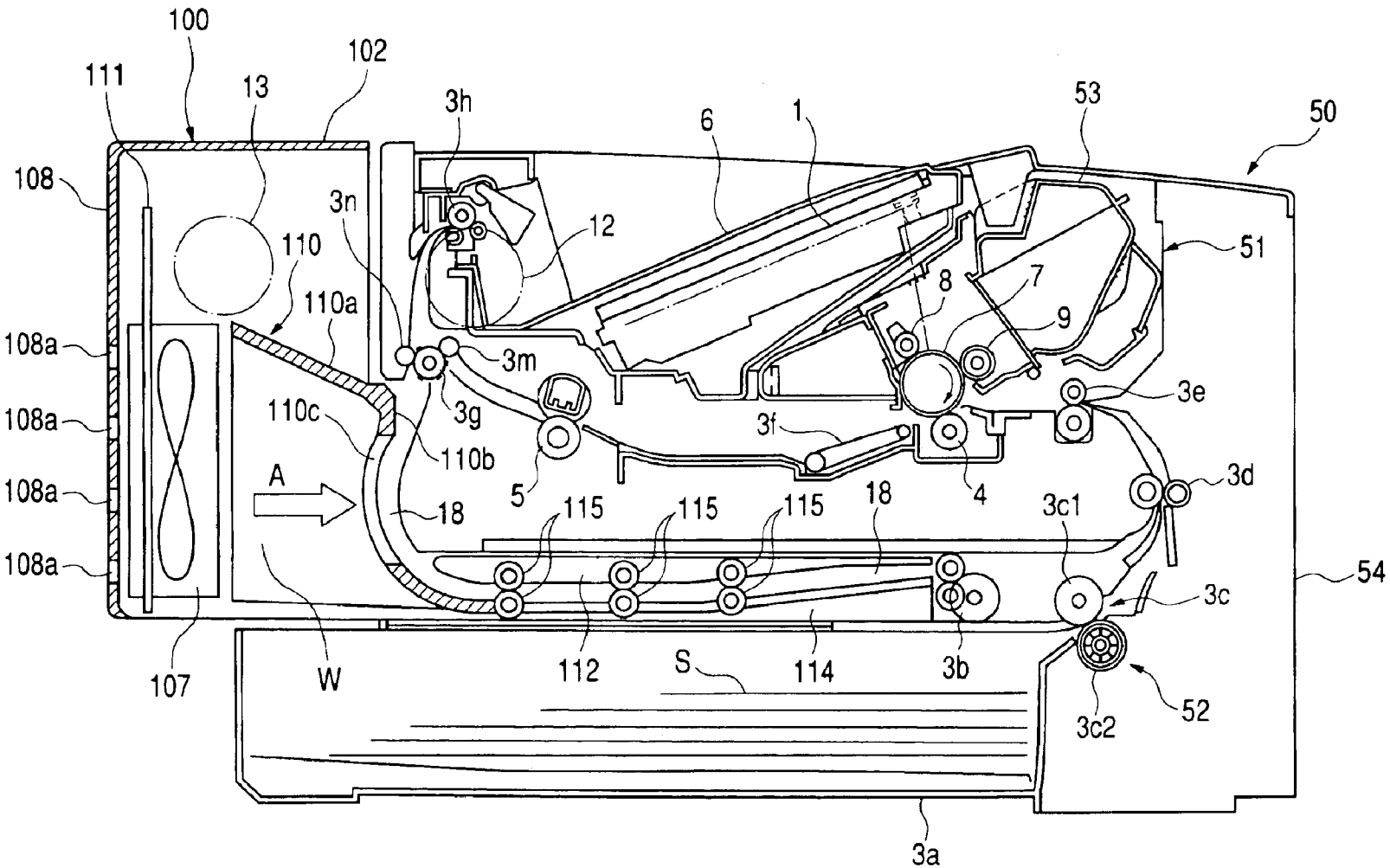
FIG. 1 is a cross-sectional view of an image forming apparatus provided with a duplex feed unit according to an embodiment of the present invention.

FIG. 1 shows a schematic construction of a laser beam printer that is an example of an image forming apparatus provided with a sheet transport apparatus according to an embodiment of the present invention.

In FIG. 1, reference numeral 50 denotes a laser beam printer that forms an image using an electrophotographic system. The laser beam printer 50 includes an image forming portion 51 that performs image formation, a sheet feeding portion 52 that separately feeds sheets S to the image forming portion 51 one by one, and the like. Also, the laser beam printer 50 is optionally equipped with a duplex feed unit 100 that, after an image is formed on one of the surfaces of a sheet S, feeds the sheet S to the image forming portion 51 again to form an image on the other surface of the sheet S. With this construction, images are formed on both surfaces of the sheet S.

Here, the image forming portion 51 includes a process cartridge 53, a transfer roller 4, and the like. On the other hand, the sheet feeding portion 52 includes a sheet feed cassette 3*a* in which the sheets S are stacked, a pickup roller 3*b*, and a separation roller pair 3*c* formed by a feed roller 3*c*1 and a retard roller 3*c*2. Note that the process cartridge 53 integrally includes a photosensitive drum 7, a charging roller (charging means) 8 for uniformly charging the surface of the photosensitive drum 7, a developing means 9 for developing an electrostatic latent image formed on the photosensitive drum 7, and the like. Here, the process cartridge 53 is detachably attachable to a main body of the laser beam printer (hereinafter referred to as the "apparatus main body") 54.

Also, the duplex feed unit 100 includes a re-transport path 18, a horizontal registration correction unit (not shown), re-feed rollers 115, and the like. Note that in FIG. 1, reference numeral 1 denotes a laser scanner unit for irradiating laser light onto the photosensitive drum, reference numeral 5 a fixing means for fixing a toner image transferred onto the sheet S, and reference numeral 6 a delivery tray on which the sheet is delivered and stacked after image formation.

Next, an image forming operation of the laser beam printer 50 having the construction described above will be described.

When image information is sent from a personal computer (not shown) or the like, a control portion (not shown) performs an image forming process on the image information and then issues a print signal. In response to this print signal, first, the photosensitive drum 7 is rotated in the arrow direction shown in FIG. 1 and is uniformly charged by the charging roller 8 to a predetermined potential in a predetermined polarity. Then, the laser scanner 1 irradiates laser light onto the photosensitive drum 7, whose surface has been charged in the manner described above, in accordance with the image information, thereby forming an electrostatic latent image on the photosensitive drum 7. Next, this electrostatic latent image is developed by the developing means 9, thereby visualizing the electrostatic latent image as a toner image.

On the other hand, in parallel with this toner image forming operation, sheets S stacked and contained in the sheet feed cassette 3*a* are picked up by the pickup roller 3*b* to be sent out and then separated from one another and transported by the separation roller pair 3*c*. Following this, the separated sheet S is further transported by transport roller pairs 3*d* and 3*e* to a transfer portion formed by the photosensitive drum 7 and the transfer roller 4.

During this operation, the leading end of the sheet S is detected by a registration sensor (not shown) provided on the upstream side of the transfer portion. On the basis of a detection signal from this registration sensor, the control portion establishes synchronization between the leading end position of the sheet S and a timing at which the laser scanner 1 emits light. As a result of this operation, the toner image formed on the photosensitive drum 7 is transferred onto the sheet S at a predetermined position.

Next, the sheet S, on which the toner image has been transferred in this manner, is sent to the fixing means 5 along a transport belt 3*f* and is heated and pressurized in the fixing means 5. As a result of this operation, the toner image is fixed in a semi-permanent manner.

Here, in the case of one-side copying, after the fixation in the fixing means 5, the sheet S is sent to a nip portion between a transport roller 3*g* that is rotatable in each of forward and reverse directions and a first runner 3*m* and is then delivered onto the delivery tray 6 by forward rotation of the transport roller 3*g* and forward rotation of a delivery roller 3*h* that is also rotatable in each of forward and reverse directions.

On the other hand, when two-side copying is performed, the delivery roller 3*h* is first rotated in the forward direction to transport the sheet S toward the delivery tray 6. Following this, when the trailing end of the sheet S has passed through the transport roller 3*g*, the delivery roller 3*h* starts reverse rotation. Here, when the trailing end of the sheet S has passed through the transport roller 3*g*, the sheet trailing end is directed toward a second runner 3*n* due to the stiffness of the sheet S. The delivery roller 3*h* starts the reverse rotation under this condition, so that the trailing end of the sheet S enters a nip portion between the transport roller 3*g* and the second runner 3*n* and is nipped therebetween.

When the sheet S is nipped between the transport roller 3*g* and the second runner 3*n* in this manner, the transport roller 3*g* is making reverse rotation, so that the sheet S passes through the re-transport path 18 of the duplex feed unit 100 and is transported to the image forming portion 51 by the transport rollers 115. Following this, after an image is formed on the second surface of the sheet S in the image forming portion 51, the sheet S is delivered by the delivery roller 3*h* and is stacked on the delivery tray 6.

It should be noted here that the delivery roller 3*h* and the transport roller 3*g* are each rotatable in each of the forward and reverse directions under the control by a separate motor 12 that is different from a drive motor (not shown) that is a main motor in the image forming apparatus main body or by a separate motor 13 provided in the duplex feed unit 100.

Next, the duplex feed unit 100 that is a sheet transport apparatus optionally provided for the apparatus main body 54 will be described. Reference numeral 102 denotes a unit cover constituting the outer surface of the duplex feed unit 100 and reference numeral 107 indicates a fan that is a cooling means for cooling the sheet S using outside air. Here, the fan 107 is provided on a side wall 108 of the unit cover 102. Also, multiple holes 108*a* for taking in the outside air are provided in the side wall 108 of the unit cover 102 at positions at which the holes 108*a* face the fan 107.

Reference numeral 110 indicates a duct member for causing the outside air blown by the fan 107 to strike the sheet passing through the re-transport path 18. This duct member 110 includes a partition wall portion 110*a*, which forms a cooling wind path (a cooling air path) W from a fan outlet to the re-transport path 18, and a transport guide portion 110*b* that constitutes a guide surface of the re-transport path 18 on the duplex feed unit side and is provided with multiple blowing holes 110*c*. Note that in the illustrated construction, the fan 107 is disposed adjacent to the duct member 110 (partition wall portion 110*a* of the duct member 110) in order to send the outside air into the re-transport path 18 with efficiency in the direction indicated by the arrow A.

In order to cool the sheet S passing through the re-transport path 18 in the duplex feed unit 100 constructed in this manner, the fan 107 is rotated to take in the outside air through the outside air intake holes 108*a*. The taken-in outside air is blown into the duct member 110 and further into the re-transport path 18 through the multiple blowing holes 110*c* provided in the transport guide portion 110*b* along the cooling wind path W formed by the partition wall portion 110*a*.

Then, the outside air blown into the re-transport path 18 in this manner is heated to a high temperature in the fixing means 5 where fixation of an unfixed toner image is performed switched back by the delivery roller 3*h*, and strikes the sheet S passing through the re-transport path 18. In this manner, the heated sheet S is cooled and therefore it becomes possible to prevent the curling of the sheet S and an increase of the temperature of the apparatus main body 54.

Following this, the cooled sheet S is re-transported to the image forming portion 51 of the apparatus main body 54 by the transport roller pairs 115 through the re-transport path 18 formed by an upper guide member 112 and a lower guide member 114 that is formed so as to extend from the transport guide portion 110*b*. Also, the outside air, whose temperature has been increased as a result of the operation for cooling the sheet S, is exhausted through an exhaust hole (not shown).

Figure 2:
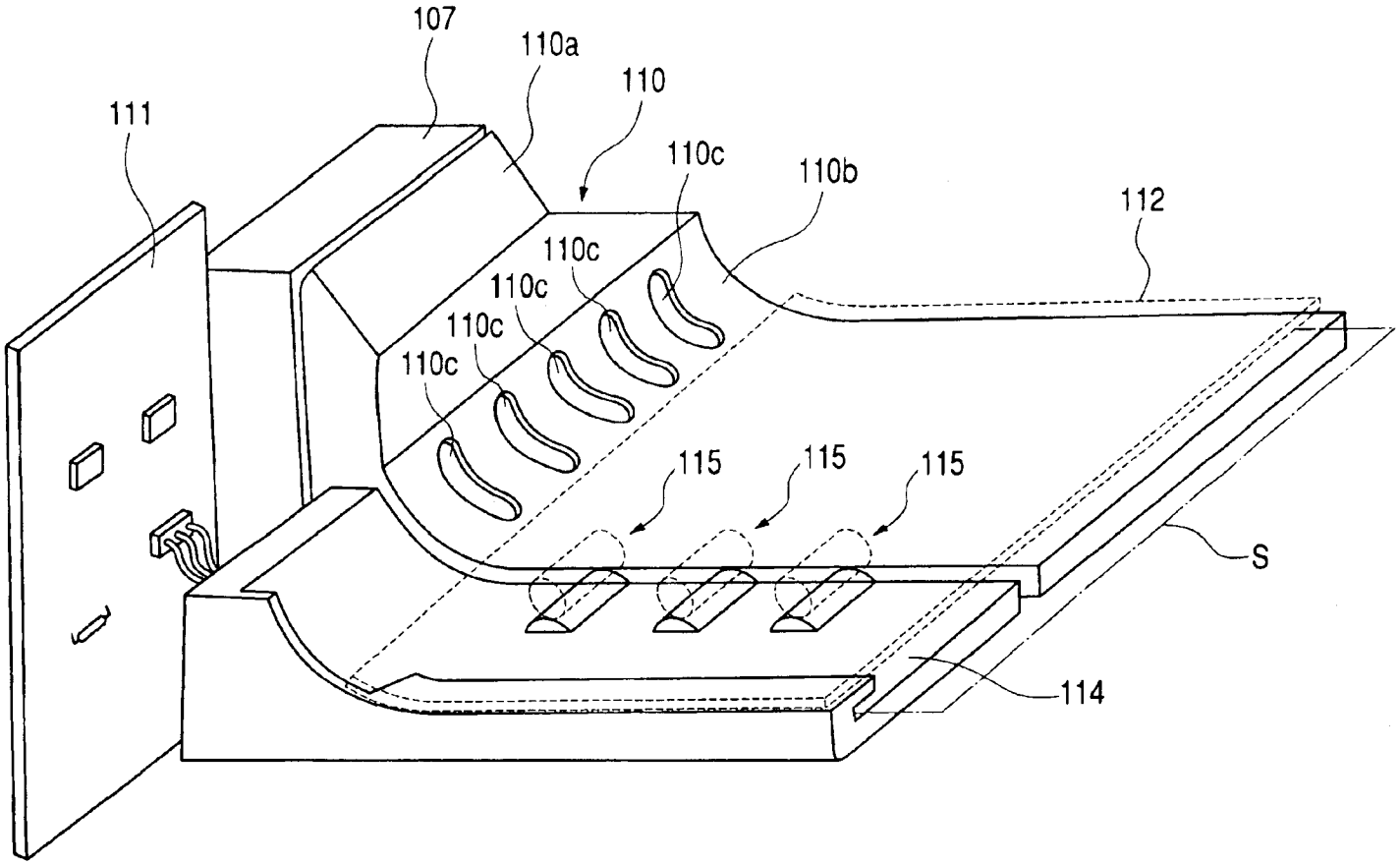
FIG. 2 is a perspective view showing a construction of the duplex feed unit shown in FIG. 1.

By the way, in FIGS. 1 and 2, reference numeral 111 denotes a control substrate that is an example of an electrical substrate for controlling the sheet re-transport operation of the duplex feed unit 100. The control substrate 111 is provided in the duplex feed unit 100 at a position spaced apart from the cooling wind path W formed by the fan 107 and the duct member 110, as shown in FIG. 2.

In order to reduce the influence of the heat of the sheet S passing through the re-transport path 18, the control substrate 111 is disposed at a position, spaced apart from the cooling path, in this embodiment. In more detail, the control substrate 111 is arranged in a side portion in a direction that is perpendicular to a direction in which the outside air flows through the duct member 110, and in the vicinity of the side wall 108 of the unit cover 102 that is close to the outside air. If the influence of the heat from the sheet is not so significant and a space remains on a side of the duct member 110, it is also possible to arrange the control substrate 111 on the side of the duct member 110.

The control substrate 111 is provided at such a position and the outside air blown by the fan 107 flows through the cooling wind path W formed by the duct member 110 in a direction in which the outside air strikes the sheet S. With this construction, it is possible to prevent the outside air, whose temperature has been increased as a result of the operation for cooling the sheet S, from striking the control substrate 111. As a result, it becomes possible to reduce the influence of the heat of the sheet S on the control substrate 111 such as increases of the temperatures of elements on the control substrate 111.

Also, as shown in FIG. 1, the fan 107 and the control substrate 111 are disposed in a side end portion of the duplex feed unit 100, making it possible to reduce the height of the duplex feed unit 100 and also to reduce the height of the laser beam printer accordingly.

The foregoing description is directed to the case where, the control substrate 111 is provided on the side the duct member 110 as shown in FIG. 2. However, the present invention is not limited to this and the control substrate 111 may be provided between the inlet opening of the fan 107 and the side wall 108 of the unit cover 102, or between the outlet opening of the fan 107 and the duct member 110, for instance.

Figure 3:
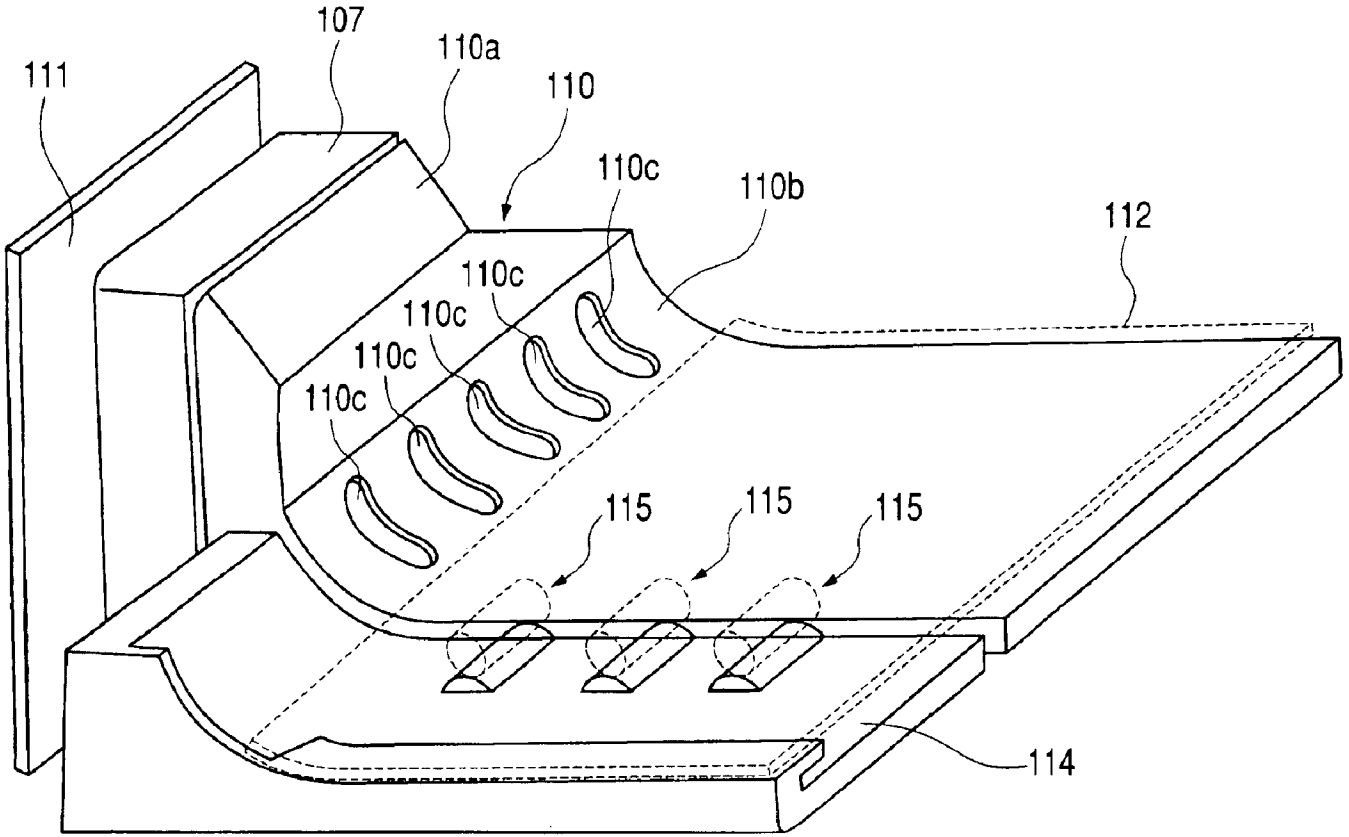
FIG. 3 is a perspective view showing another construction of a duplex feed unit.
Figure 4:
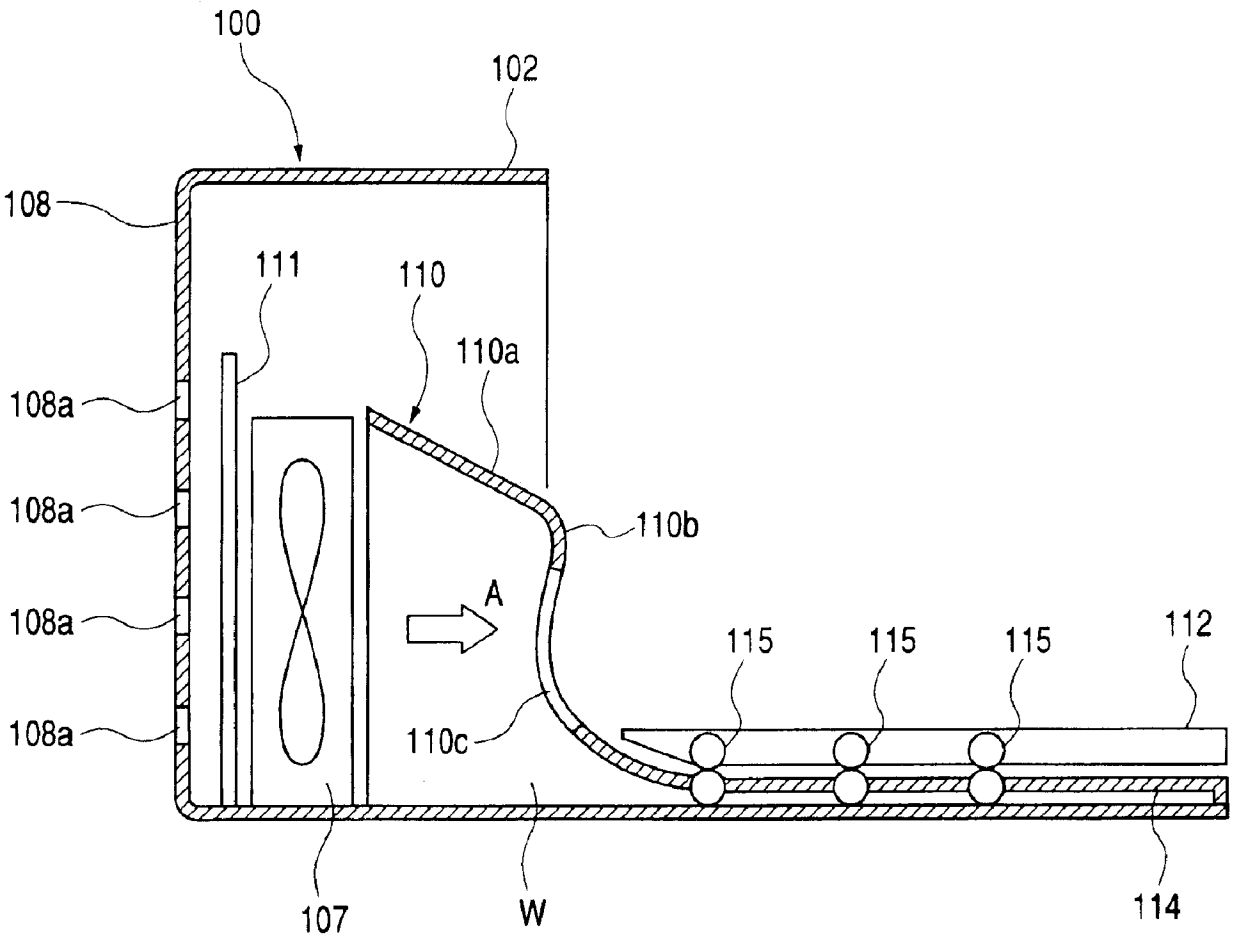
FIG. 4 is a cross-sectional view of the duplex feed unit shown in FIG. 3.

FIG. 3 is a perspective view showing another construction of a duplex feed unit. FIG. 4 is a cross-sectional view of the duplex feed unit as shown in FIG. 3. As shown in FIG. 3, in this embodiment, the control substrate 111 is arranged between the inlet opening of the fan 107 and the outside air intake holes 108*a* provided in the side wall 108 of the unit cover 102. When the duplex feed unit is constructed in this manner, a predetermined space is maintained between the control substrate 111 and the fan 107 as shown in FIG. 4, thereby allowing the fan 107 to take in the outside air.

Also, the control substrate 111 is arranged at such a position, so that the outside air used to cool the sheet is prevented from striking the control substrate 111. As a result, it becomes possible to reduce the influence of heat of the sheet S on the control substrate 111 such as increases of the temperatures of elements on the control substrate 111. Further, with this construction, the heat generated by the control substrate 111 itself is cooled with the outside air directly taken-in by the fan 107, making it possible to further reduce the influence of the heat such as the increases of the temperatures of the elements.

Figure 5:
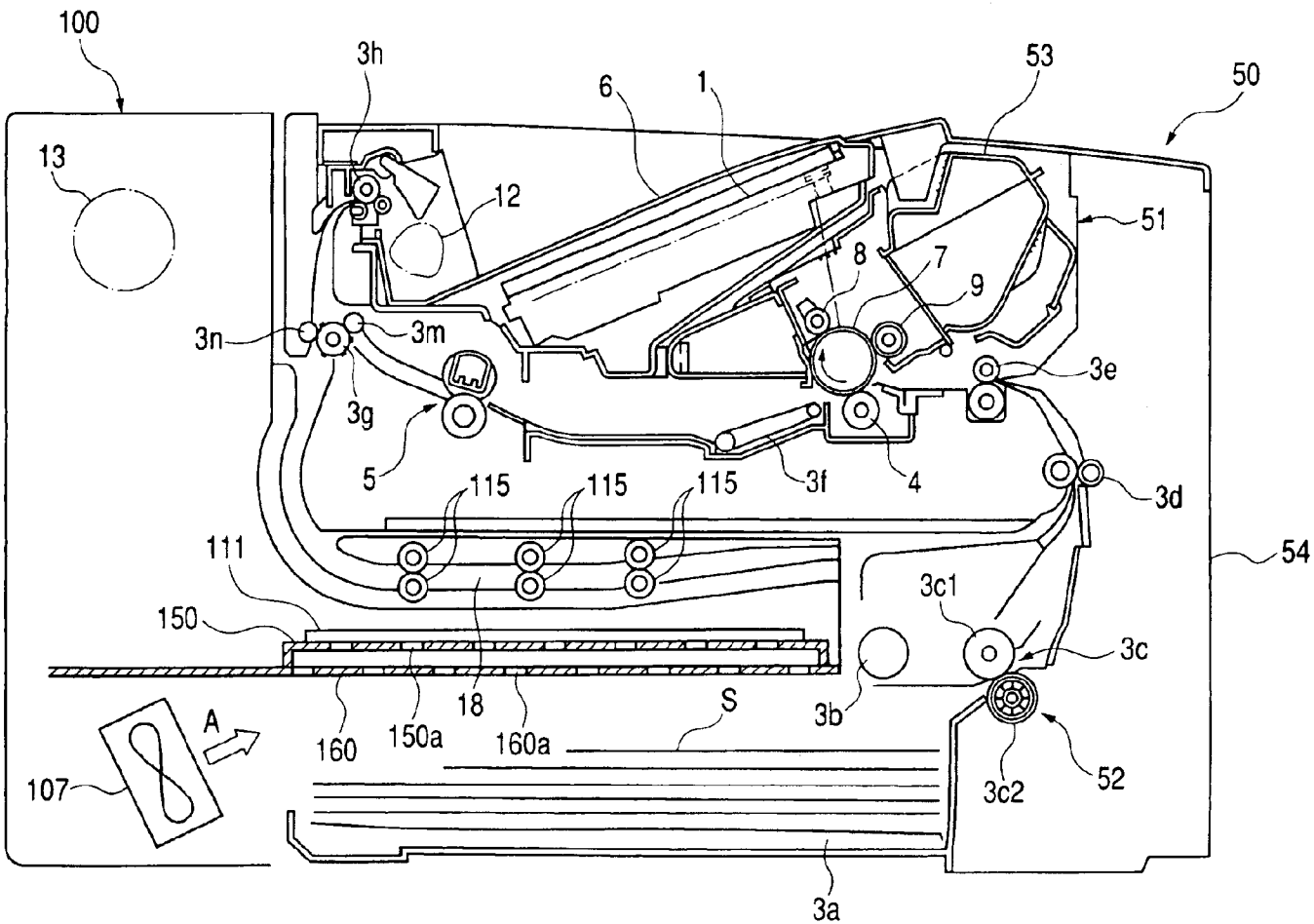
FIG. 5 is a cross-sectional view of an image forming apparatus provided with a duplex feed unit having a still another construction.

FIG. 5 is a cross-sectional view showing another arrangement of the fan 107 and the control substrate 111. As shown in FIG. 5, the control substrate 111 is provided below the re-transport path 18 in the duplex feed unit 100 and is held by bottom boards 150 and 160 of the duplex feed unit 100. Here, the duplex feed unit 100 is provided with the fan 107 that prevents heat generation of the elements on the control substrate and cools the sheet S heated as a result of the heating operation in the fixing means 5.

This fan 107 blows air in the direction indicated by the arrow A, thereby allowing the air (outside air), which has passed through multiple holes 150*a* and 160*a* provided in the bottom boards 150 and 160, to strike the control substrate 111 and the sheet S. As a result, it becomes possible to cool both of the control substrate 111 and the sheet S.

What is claimed is:

1. A sheet transport apparatus that re-transports a sheet having an image formed by an image forming portion on a first surface of the sheet, to the image forming portion so as to form an image on a second surface, opposite to the first surface, of the sheet, said sheet transport apparatus comprising:

a re-transport path through which the sheet having the image on the first surface of the sheet is re-transported to the image forming portion;

cooling means for blowing air against the sheet passing through said re-transport path in order to cool the sheet;

an electrical substrate; and a cooling air path which is provided between said cooling means and said re-transport path and through which the air blown by said cooling means flows into said re-transport path, wherein said electrical substrate is arranged at a position off said cooling air path.

2. A sheet transport apparatus according to claim 1 further comprising a duct member constituting said cooling air path, wherein said electrical substrate is arranged in a side portion in a direction that is perpendicular to a direction in which the air flows through said duct member.

3. A sheet transport apparatus that re-transports a sheet having an image formed by an image forming portion on a first surface of the sheet, to the image forming portion so as to form an image on a second surface, opposite to the first surface, of the sheet, said sheet transport apparatus comprising:

a re-transport path through which the sheet having the image on the first surface of the sheet is re-transported to the image forming portion;

cooling means for blowing air against the sheet passing through said re-transport path in order to cool the sheet;

an electrical substrate; and a cooling air path which is provided between said cooling means and said re-transport path and through which the air blown by said cooling means flows into said re-transport path, wherein said electrical substrate is arranged on an upstream side in a direction in which the air flows through said cooling air path.

4. A sheet transport apparatus according to claim 3, wherein said cooling means is a fan, and wherein said electrical substrate is arranged on an inlet side of said fan.

5. A sheet transport apparatus according to claim 3, further comprising a duct member for causing the air blown by said cooling means to flow into the re-transport path, wherein said electrical substrate, said cooling means, said duct member, and said re-transport path are arranged in the named order from an upstream side along a flowing direction of the air blown by said cooling means.

6. A sheet transport apparatus according to claim 1 or 4, wherein said electrical substrate is a control substrate that controls a re-transporting operation for the sheet.

7. An image forming apparatus having a sheet transport apparatus that re-transports a sheet having an image formed by an image forming portion on a first surface of the sheet, to the image forming portion in order to form an image on a second surface, opposite to the first surface, of the sheet, said image forming apparatus comprising:

a re-transport path through which the sheet having the image formed on the first surface of the sheet is re-transported to said image forming portion;

cooling means for blowing air against the sheet passing through said re-transport path in order to cool the sheet;

an electrical substrate; and a cooling air path which is provided between said cooling means and said re-transport path and through which the air blown by said cooling means flows into said re-transport path;

wherein said electrical substrate is arranged at a position off said cooling air path.

8. An image forming apparatus according to claim 7, wherein said re-transport path, said cooling means, and said electrical substrate are integrated into a unit that is detachably attachable to a main body of said image forming apparatus.

9. An image forming apparatus comprising:

a photosensitive drum on which a toner image is formed;

a fixing roller that heats and pressurizes a sheet onto which the toner image has been transferred from said photosensitive drum;

a re-transport path that connects a downstream side path of said fixing roller and an upstream side path of said photosensitive drum;

a fan that blows air; and an electrical substrate, wherein said electrical substrate, said fan, and said re-transport path are arranged in the named order from an upstream side along a flowing direction of the air blown from said fan.

10. An image forming apparatus according to claim 9, wherein said electrical substrate, said fan, and said re-transport path are integrated into a unit that is detachably attachable to a main body of said image forming apparatus.

11. An image forming apparatus having a sheet transport apparatus that re-transports a sheet having an image formed by an image forming portion on a first surface of the sheet, to the image forming portion in order to form an image on a second surface, opposite to the first surface, of the sheet, said image forming apparatus comprising:

a re-transport path through which the sheet having the image formed on the first surface of the sheet is re-transported to said image forming portion;

cooling means for blowing air against the sheet passing through said re-transport path in order to cool the sheet;

an electrical substrate; and a cooling air path which is provided between said cooling means and said re-transport path and through which the air blown by said cooling means flows into said re-transport path, wherein said electrical substrate is arranged on an upstream side in a direction in which the air flows through said cooling air path.

* * * * *

UNITED STATES PATENT AND TRADEMARK OFFICE

CERTIFICATE OF CORRECTION

PATENT NO. : 6,954,602 B2
DATED : October 11, 2005
INVENTOR(S) : Eiichiro Kimizuka It is certified that error appears in the above-identified patent and that said Letters Patent is hereby corrected as shown below:

Column 2,
Line 46, the second occurrence of "a" should be deleted.

Column 7,
Line 18, "claim 1 or 4," should read -- claim 1 or 3, --.

Signed and Sealed this

Twenty-first Day of February, 2006

JON W. DUDAS
*Director of the United States Patent and Trademark Office*